US010724538B2

(12) United States Patent
Nakaniwa et al.

(10) Patent No.: US 10,724,538 B2
(45) Date of Patent: Jul. 28, 2020

(54) CENTRIFUGAL COMPRESSOR

(71) Applicant: MITSUBISHI HEAVY INDUSTRIES COMPRESSOR CORPORATION, Tokyo (JP)

(72) Inventors: Akihiro Nakaniwa, Tokyo (JP); Satoru Yoshida, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 106 days.

(21) Appl. No.: 15/547,392

(22) PCT Filed: Sep. 16, 2015

(86) PCT No.: PCT/JP2015/076330
§ 371 (c)(1),
(2) Date: Jul. 28, 2017

(87) PCT Pub. No.: WO2016/125335
PCT Pub. Date: Aug. 11, 2016

(65) Prior Publication Data

US 2018/0023589 A1 Jan. 25, 2018

(30) Foreign Application Priority Data

Feb. 3, 2015 (JP) ..... 2015-019347

(51) Int. Cl.
*F04D 29/44* (2006.01)
*F04D 29/28* (2006.01)
(Continued)

(52) U.S. Cl.
CPC ..... *F04D 29/444* (2013.01); *F04D 29/286* (2013.01); *F04D 29/4206* (2013.01); *F04D 17/122* (2013.01); *F05D 2250/51* (2013.01)

(58) Field of Classification Search
CPC combination set(s) only.
See application file for complete search history.

(56) References Cited

U.S. PATENT DOCUMENTS

2004/0187475 A1* 9/2004 Usab, Jr. ..... F01D 5/142 60/204
2009/0205362 A1* 8/2009 Haley ..... F04D 17/122 62/510
2013/0259644 A1* 10/2013 Kobayashi et al. .. F04D 17/122 415/68

FOREIGN PATENT DOCUMENTS

GB 167131 A * 9/1921 ..... F04D 29/444
JP 2010-071140 A 4/2010
JP 2015017536 A * 1/2015 ..... F02M 35/1211

OTHER PUBLICATIONS

Machine Translation of JP 2015-017536 A PDF File Name: "JP2015017536A_Machine_Translation.pdf" (Year: 2015).*
(Continued)

*Primary Examiner* — Lindsay M Low
*Assistant Examiner* — Ruben Picon-Feliciano
(74) *Attorney, Agent, or Firm* — Osha Liang LLP

(57) ABSTRACT

A centrifugal compressor includes an impeller that rotates about an axis; an inlet guide vane including a plurality of vanes disposed on an upstream side of the impeller and provided at intervals in a circumferential direction of the axis, the inlet guide vane being directed inward in the radial direction between adjacent vanes, and forming a guide flow path having an exit angle in the radial direction and guiding the fluid; and a suction flow path that introduces the fluid from a part in a circumferential direction into the inlet guide vane. The exit angle of the vane of the first region on the one side when viewed from the suction flow path in the inlet guide vane is displaced to the suction flow path side as
(Continued)

compared to the exit angle of the vane of a second region on the opposite side of the one side.

5 Claims, 7 Drawing Sheets

(51) Int. Cl.
*F04D 29/42* (2006.01)
*F04D 17/12* (2006.01)

(56) References Cited

OTHER PUBLICATIONS

International Search Report issued in corresponding International Application No. PCT/JP2015/076330 dated Dec. 8, 2015 (3 pages).
Written Opinion issued in corresponding International Application No. PCT/JP2015/076330 dated Dec. 8, 2015 (6 pages).

* cited by examiner

CENTRIFUGAL COMPRESSOR

TECHNICAL FIELD

One or more embodiments of the present invention relate to a centrifugal compressor.

CROSS-REFERENCE TO RELATED APPLICATIONS

Priority is claimed on Japanese Patent Application No. 2015-019347, filed Feb. 3, 2015, the content of which is incorporated herein by reference.

BACKGROUND

In general, a centrifugal compressor includes an impeller provided on a rotary shaft, and a casing which defines a flow path with the impeller by covering the impeller from the outside. The flow path is formed so that a flow path area gradually decreases from an upstream side toward a downstream side. As a result, external fluid is suctioned into the casing by the rotation of the impeller, and pressure is applied to the fluid while flowing through the flow path the fluid to discharge the fluid from the casing in a high-pressure state.

In recent years, there has been an increased demand for adopting a small casing to reduce an installation space of the compressor. When adopting a small casing, an unbalance may occur in the flow rate distribution flowing into the impeller. Due to the unbalance of the flow rate, since an attack angle to the impeller increases in a region in which the axial flow velocity decreases, there is a possibility of occurrence of stalling or surging. As a result, the operation range of the compressor may be narrowed.

As a technique for avoiding such stalling, a technique described in the following Patent Literature 1 is known. In a turbocharger described in Patent Literature 1, four fan-shaped blades are provided in a compressor introduction pipe for introducing air from the outside. These blades are rotatably supported (able to be freely opened and closed) on axes extending in the radial direction of the compressor. The degree of opening of the blades is adjusted in accordance with the flow rate of the compressed air. This makes it possible to variably control the capacity of the turbocharger and to avoid stalling of the air inside and outside the compressor introduction port.

In the device described in the above-mentioned Patent Literature 1, the compressor introduction pipe extends in the same direction as the rotation axis of the impeller. That is, the external air is configured to be guided from the axial direction to the inside of the turbocharger. However, various configurations have been proposed as an intake port (intake casing) used in a centrifugal compressor.

For example, an example is known in which an intake casing extending radially outward from a part of the axis of the impeller in the circumferential direction is provided in a single-shaft multistage centrifugal compressor. More specifically, such an intake casing includes a volute extending radially outward from the vicinity of the inlet of the impeller, and an intake port formed at the radially outer end portion of the volute. Such an intake casing covers the impeller from one side in the axial direction. Furthermore, an opening communicating with the upstream side of the impeller is provided inside the intake casing. After passing through the interior of the volute, the external air taken in from the intake port flows from the outer side toward the inner side in the radial direction through the opening formed in the intake casing, and is taken into the flow path inside the impeller.

In the centrifugal compressor of this type, it is common to avoid stalling, by providing the inlet guide vanes in the vicinity of the opening of the intake casing (that is, in the vicinity of the inlet of the impeller) as members corresponding to the blades of the turbocharger of the above-mentioned Patent Literature 1.

CITATION LIST

Patent Literature

[Patent Literature 1]

Japanese Unexamined Patent Application, First Publication No. 2010-71140

However, when adopting the above-described configuration, air is directed from the radially outer side toward the inner side in the entire circumferential direction, while the impeller rotates in one direction. Thus, at the inlet of the impeller, a region in which air flows in a forward direction and a region in which air flows in an opposite direction are formed. As a result, unbalance occurs in the flow rate distribution of air in the circumferential direction of the impeller. When a drift occurs in the circumferential direction of the impeller due to the unbalance of the flow rate distribution, there is a possibility of local stalling. Thus, there is a possibility of lowering the compression efficiency of the centrifugal compressor.

SUMMARY

One or more embodiments of the present invention provide a centrifugal compressor capable of achieving a sufficient compression efficiency by the occurrence of stalling or surging due to unbalance of the flow rate being minimized.

One or more embodiments of the present invention employ the following means.

According to a first aspect of one or more embodiments of the present invention, there is provided a centrifugal compressor including: an impeller which rotates about an axis; inlet guide vanes including a plurality of vanes disposed on one side of the impeller in an axial direction and provided at intervals in a circumferential direction with respect to the axis, the inlet guide vane being directed inward in the radial direction between adjacent vanes, and forming a guide flow path having an exit angle in the radial direction and guiding the fluid; and a suction flow path which introduces the fluid from a part on a circumferential direction side into the inlet guide vanes, wherein the exit angle of the vane of the first region on the one side when viewed from the suction flow path in the inlet guide vanes is displaced to the suction flow path side as compared to the exit angle of the vane of the second region on the side opposite to the one side.

According to the above configuration, since the exit angle of the vane in the first region is displaced to the suction flow path side as compared to the exit angle of the second region, the flow direction of the fluid in the first region can be changed toward the suction flow path side. As a result, it is possible to roughly balance the flow rate distribution of the fluid flowing toward the impeller via the suction flow path between the first region and the second region.

According to a second aspect of one or more embodiments of the present invention, in the centrifugal compressor according to the first aspect, the first region may be a region on a front side of the impeller in the rotating direction when viewed from the suction flow path in the inlet guide vanes.

According to the above configuration, it is possible to change the flow direction of the fluid in the first region located on the front side of the impeller in the rotating direction toward the suction flow path side. As a result, it is possible to equally balance the flow rate distribution of the fluid flowing toward the impeller via the suction flow path between the first region and the second region.

According to a third aspect of one or more embodiments of the present invention, in the centrifugal compressor according to the first aspect, the first region may be a region on a rear side of the impeller in the rotating direction when viewed from the suction flow path in the inlet guide vanes.

Also with the above configuration, it is possible to change the flow direction of the fluid toward the suction flow path side in the first region located on the rear side of the impeller in the rotating direction. As a result, it is possible to equally balance the flow rate distribution of the fluid flowing toward the impeller via the suction flow path between the first region and the second region.

According to a fourth aspect of one or more embodiments of the present invention, in the centrifugal compressor according to the first aspect, the exit angle of the vane in the first region may be in the range of 10° to 20° with respect to the radial direction of the impeller.

According to the configuration as described above, it is possible to sufficiently change the flow direction of the fluid in the first region, and to avoid the possibility of excessively limiting the flow rate of the fluid taken into the suction flow path.

According to a fifth aspect of one or more embodiments of the present invention, in the centrifugal compressor according to any one of the first to fourth aspects, the exit angle of the vane in a region in which an angular coordinate about the axis in the circumferential direction from the suction flow path as viewed from the axial direction in the first region is in the range of 45° to 180° may be displaced toward the suction flow path side compared to the exit angle of the vane of the second region.

According to the above configuration, it is possible to sufficiently change the flow direction of the fluid in the region in which the angular coordinate about the axis in the first region is in the range of 45° to 180°. In this region, there is a possibility that the flow rate distribution of the fluid is particularly disturbed. However, according to the above configuration, it is possible to sufficiently minimize occurrence of such turbulence in the flow rate distribution.

According to a sixth aspect of one or more embodiments of the present invention, in the centrifugal compressor according to any one of the first to fifth aspects, the exit angle may become larger in the first region, as the vane is provided at positions further away from the suction flow path in the circumferential direction.

According to the aforementioned configuration, it is possible to better balance the flow rate distribution of the fluid in the circumferential direction in the first region. Therefore, it is possible to reduce the likelihood of occurrence of circumferential drift in the first region.

Advantageous Effects

According to aspects of one or more embodiments of the present invention, it is possible to provide a centrifugal compressor having sufficient compression efficiency.

DETAILED DESCRIPTION

First Embodiment

Hereinafter, a first embodiment of the present invention will be described with reference to the drawings.

Figure 1:
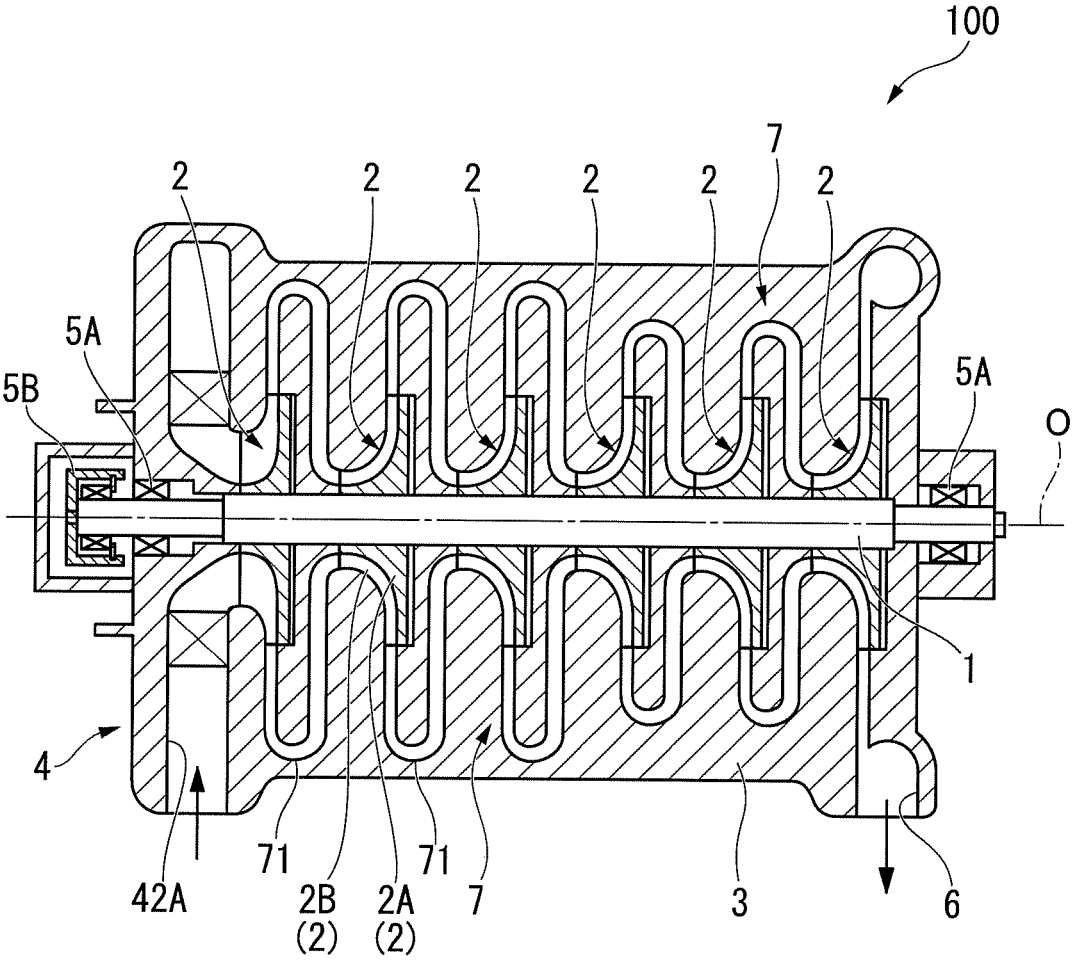
FIG. 1 is a schematic diagram illustrating a configuration of a centrifugal compressor according to an embodiment of the present invention.

As illustrated in FIG. 1, a centrifugal compressor 100 according to the present embodiment is a uniaxial multistage compressor which includes a single rotary shaft 1, and a plurality of impellers 2.

The centrifugal compressor 100 includes a rotary shaft 1 rotating about an axis O, an impeller 2 attached to the rotary shaft 1 which compresses a fluid using a centrifugal force, a casing main body 3 which rotatably supports the rotary shaft 1 and in which is formed a main flow path 7 through which fluid flows from one side in the direction of the axis O to the other side, and an intake casing 4 through which the main flow path 7 communicates with the outside.

The casing main body 3 is formed to form a substantially cylindrical outer shell, and the rotary shaft 1 is disposed to penetrate through the center thereof. Journal bearings 5A and thrust bearings 5B are provided on both sides of the casing main body 3, respectively, to rotatably support the rotary shaft 1. That is, the rotary shaft 1 is supported by the casing main body 3 via the journal bearings 5A and the thrust bearings 5B.

The intake casing 4 for taking the fluid from the outside is provided on one end side of the casing main body 3 in the direction of the axis O, and a discharge port 6 for exhausting the fluid to the outside is provided on the other end side thereof. Inside the casing main body 3, internal spaces which communicate with the intake casing 4 and the discharge port 6, respectively, and repeat diameter reduction and diameter expansion are provided. The internal space functions as a space for storing the impeller 2 and also functions as the main flow path 7. That is, the intake casing 4 and the discharge port 6 communicate with each other via the impeller 2 and the main flow path 7.

In the centrifugal compressor 100 according to the present embodiment, six impellers 2 are provided at intervals in the direction of axis O. Each impeller 2 has a substantially disk-like hub 2A gradually expanding in diameter toward the discharge port 6 side, and a plurality of blades 2B radially attached to the hub 2A and aligned in the circumferential direction.

Although not illustrated in detail, the impeller 2 may be configured as a so-called closed type, by further providing a shroud that covers the plurality of blades 2B from one side in the direction of the axis O.

The main flow path 7 is formed to connect each impeller 2 so that the fluid is compressed in stages. A portion of the main flow path 7 passing through the impeller 2 is an impeller passage 71. The impeller passage 71 is a flow path formed between a pair of adjacent blades 2B.

In such a configuration, the fluid is compressed by each impeller 2 in the middle of flowing through the main flow path 7. That is, in the centrifugal compressor 100, the fluid is compressed stepwise by the six impellers 2, thereby obtaining a large compression ratio.

Figure 2:
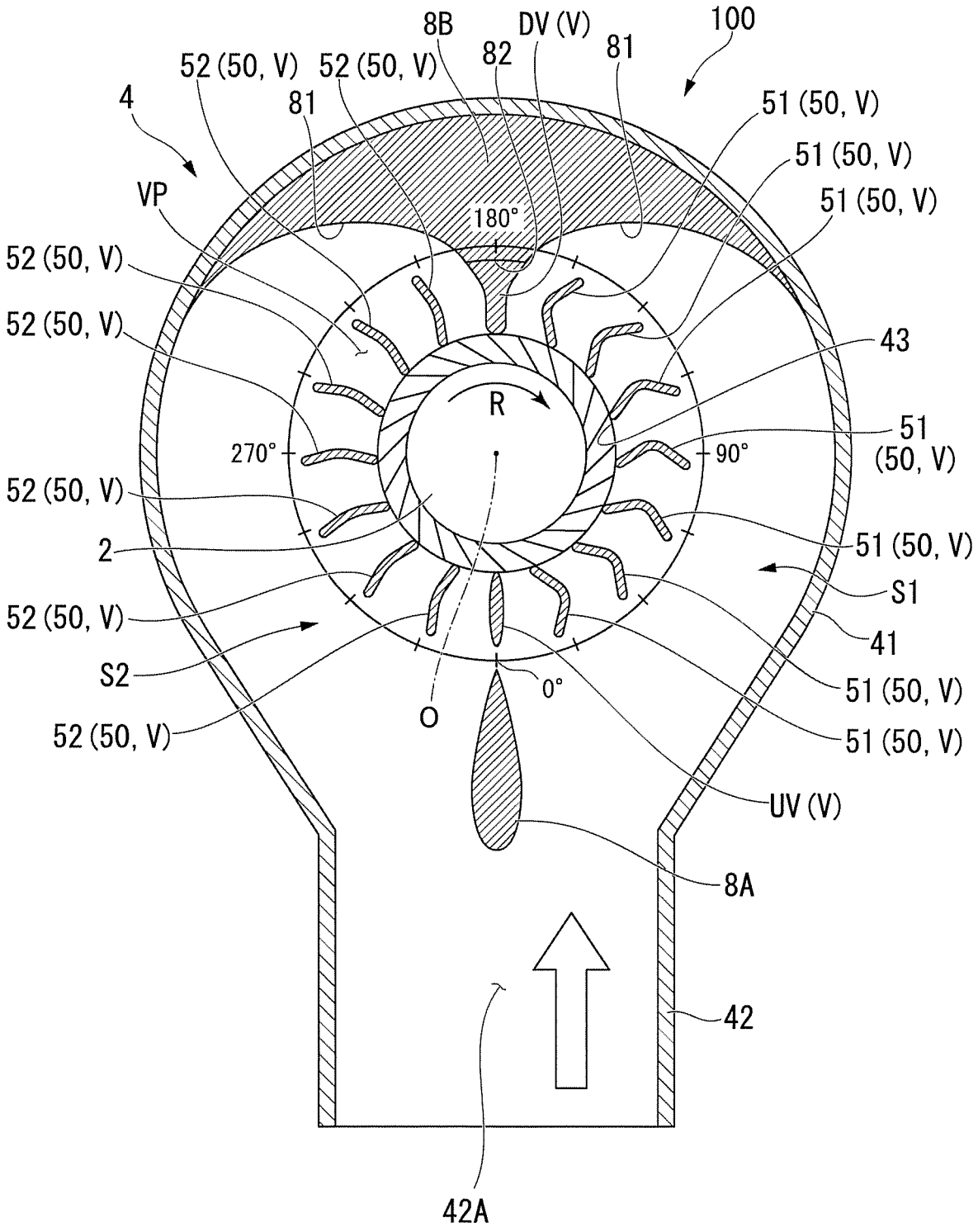
FIG. 2 is a cross-sectional view in an axial direction of an intake casing of the centrifugal compressor according to a first embodiment of the present invention.

An intake casing 4 is provided in the centrifugal compressor 100 according to the present embodiment. Specifically, as illustrated in FIG. 2, the intake casing 4 includes an annular portion 41 having substantially the same contour line as the casing main body 3 when viewed from one side in the direction of the axis O, and a volute portion 42 extending radially outward from a part of the annular portion 41 in the circumferential direction. The interior of the volute portion 42 is a suction flow path 42A through which the fluid flows. An end portion of the suction flow path 42A on the side opposite to the annular portion 41 is open toward the outside. That is, the external fluid is taken in from the radially outer side with respect to the axis O toward the main flow path 7 via the volute portion 42 (suction flow path 42A).

The inner space of the annular portion 41 communicates with the impeller passage 71 of the first stage impeller 2 through the intake casing opening 43. The intake casing opening 43 is a substantially circular opening portion provided in a region including the axis O in the annular portion 41. As illustrated in FIG. 2, from the intake casing opening 43, each blade 2B of the impeller 2 and each impeller passage 71 formed by the blades 2B are exposed to the internal space of the annular portion 41.

In the following description, the radially outer side of the volute portion 42 inside the intake casing 4 is referred to as an upstream orientation, an upstream side, or the like, and an orientation opposite thereto is referred to as a downstream orientation, a downstream side, or the like.

Further, in the following description, an arbitrary position in the circumferential direction in the intake casing opening 43 is expressed by an angular coordinate extending in a counterclockwise direction when viewed from one side in the direction of the axis O, with the end portion on the furthest upstream side as a reference (0°). For example, as illustrated in FIG. 2, when viewed from the upstream-most side of the intake casing opening 43, the position on the downstream side across the impeller 2 (axis O) is expressed as 180°.

Inside the annular portion 41, an upstream straightening portion 8A and a downstream straightening portion 8B for guiding the flow of the flowing fluid are provided. The upstream straightening portion 8A is a straightening fin provided at a position of 0° on the peripheral edge of the intake casing 4. More specifically, the upstream straightening portion 8A is a member having an airfoil cross section extending in a direction orthogonal to the axis O, that is, in a radial direction.

Further, the downstream straightening portion 8B is provided at the position of 180°, that is, on the downstream inner wall surface in the annular portion 41. The downstream straightening portion 8B is a substantially triangular member which is symmetrically formed on the basis of the upstream and downstream directions. More specifically, the downstream straightening portion 8B has two circular arc portions 81 extending from the inner peripheral circle of the annular portion 41 in substantially upstream direction with a larger curvature. The adjacent edges of the two circular arc portions 81 are connected to each other by a connecting portion 82 at a position of 180° on the periphery of the intake casing opening 43.

The fluid introduced from the outside via the volute portion 42 is guided by the upstream straightening portion 8A and the downstream straightening portion 8B. More specifically, first, the fluid guided from the volute portion 42 is divided into two flows across the axis O by the upstream straightening portion 8A. That is, the fluid is divided into the flow which reaches the 180° position (downstream straightening portion 8B) from the upstream straightening portion 8A via the 90° position, and the flow which reaches the 180° position (downstream straightening portion 8B) from the upstream straightening portion 8A via the 270° position, across the intake casing opening 43.

In this embodiment, the regions through which the two flows circulate are referred to as a first region S1 and a second region S2, respectively. That is, as described above, the region on the side including the 90° position is set as the first region S1, and the region on the side including the 270° position is set as the second region S2. Inside the first region S1 and the second region S2, the fluid flowing from the upstream side to the downstream side flows toward the intake casing opening 43 in the middle thereof. Meanwhile, the flow direction of the fluid that has reached the vicinity of the 180° position is forcibly changed by the downstream straightening portion 8B. That is, after the flow direction of the fluid is reversed toward the downstream side by the circular arc portion 81 of the downstream straightening portion 8B, the fluid is guided toward the intake casing opening 43. As described above, inside the intake casing 4, the fluid is guided from the entire region in the circumferential direction including the first region S1 and the second region S2 toward the intake casing opening 43.

In order to guide the fluid flowing toward the intake casing opening 43 as described above, inlet guide vanes V are provided on the peripheral edge portion of the intake casing opening 43. The inlet guide vanes V include a plurality of vanes 50 arranged circumferentially at intervals over the first region S1 and the second region S2. The interval between a pair of vanes 50 adjacent to each other is a guide flow path VP for guiding the fluid from the outer side to the inner side in the radial direction.

In the following description, among the plurality of vanes 50, the vane 50 provided in the first region S1 is defined as the first vane 51 and the vane 50 provided in the second region S2 is defined as the second vane 52 to distinguish both vanes. More specifically, seven first vanes 51 and seven second vanes 52 are provided in the first region S1 and the second region S2, respectively, at angular intervals of 22.5° in the circumferential direction.

Further, an upstream vane UV and a downstream vane DV having shapes different from those of the first vane 51 (the second vane 52) are provided at the 0° position and the 180° position of the intake casing opening 43. The upstream vane UV is a member having an airfoil cross section extending linearly in the radial direction, like the upstream straightening portion 8A. Meanwhile, the downstream vane DV is formed such that both surfaces facing the circumferential direction are gradually become further away from each other, from the inner side toward the outer side in the radial direction. Further, both circumferential surfaces are curved toward the direction of approaching each other. In the present embodiment, the downstream vane DV is connected to the downstream straightening portion 8B via the connecting portion 82. The downstream vane DV may be formed integrally with the downstream straightening portion 8B as described above, or may be formed as a separate body.

Here, in the centrifugal compressor 100, the rotary shaft 1 and the impeller 2 rotate in the same direction during operation. In the present embodiment, an example will be described in which the rotating direction of the rotary shaft 1 is clockwise when viewed from one side in the direction of the axis O (FIG. 2). That is, in the present embodiment, the impeller 2 rotates in the direction from the second region S2 to the first region S1. Therefore, in the second region S2, the fluid guided by the inlet guide vane V flows into the intake casing opening 43 with a direction component substantially along the rotating direction R of the impeller 2. Meanwhile, the fluid in the first region S1 flows into the intake casing opening 43 with a direction component opposite to the rotating direction RR of the impeller 2.

Therefore, in some cases, the flow rate of the fluid taken into the impeller 2 (the impeller passage 71) may be different between the first region S1 and the second region S2. Specifically, there is a possibility of the flow rate distribution as illustrated by the dotted line graph in FIG. 4 being obtained. According to the dotted line graph in FIG. 4, the flow rate of the fluid taken into the impeller passage 71 gradually decreases in the region from the 0° position to the 180° position (i.e., the first region S1). Meanwhile, in the region from the 180° position to the 360° position (i.e., the second region S2), the flow rate of the fluid gradually increases.

In this way, when the flow rate deviates in the circumferential direction of the intake casing opening 43 (the impeller 2), the head of the impeller 2 in the second region S2 becomes excessive as compared with the head in the first region S1. Thus, there is a possibility that local stalling may occur in a part of the impeller 2 in the circumferential direction.

Therefore, in the centrifugal compressor 100 according to the present embodiment, for the purpose of suppressing the deviation of the flow rate distribution in the circumferential direction, the inlet guide vanes V are divided into the first region S1 (the first vane 51) and the second region S2 (the second vane 52) having different shapes.

Figure 3:
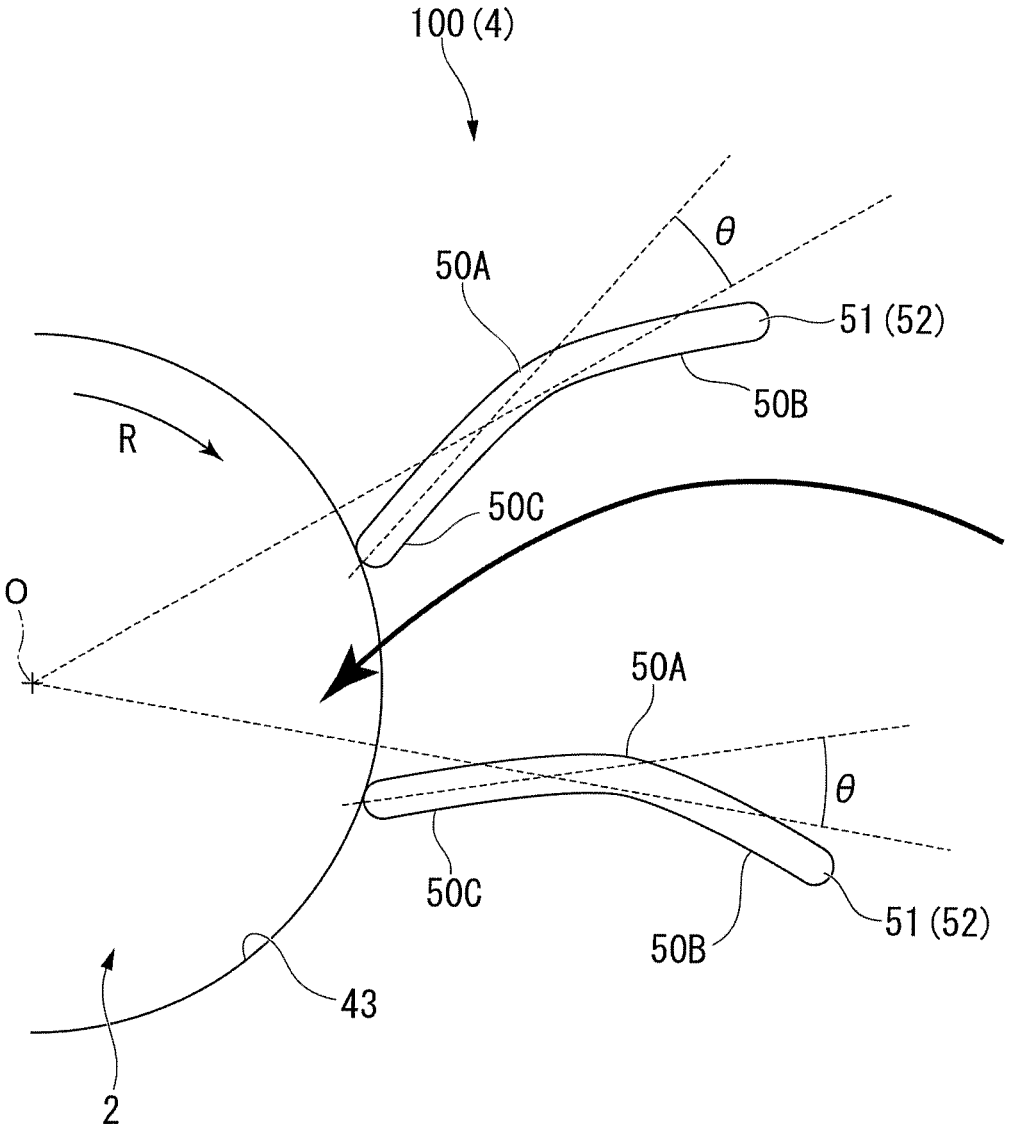
FIG. 3 is an enlarged view of an inlet guide vane according to the first embodiment of the present invention.

Before explaining the difference between the shapes of the first vane 51 and the second vane 52, the configuration of each part defining the shape of the vane 50 will be described with reference to FIG. 3. As illustrated in FIG. 3, in the present embodiment, the individual vanes 50 generally extend in the radial direction of the axis O. More specifically, the vane 50 is formed in an approximate C shape by bending its central portion toward the downstream side. That is, the inner surface of each vane 50 in the bending direction generally faces the upstream side.

The vane 50 thus formed to be curved has a leading edge portion 50B extending substantially linearly outward in the radial direction from the curved portion 50A, and a trailing edge portion 50C extending inward in the radial direction. The circulation direction of the fluid flowing toward the intake casing opening 43 is changed, while passing through the trailing edge portion 50C from the leading edge portion 50B of the vane 50. At this time, an angle formed between the direction from the curved portion 50A to the radially inner end of the trailing edge portion 50C and the radial direction of the axis O is defined as an exit angle θ. That is, inside the intake casing 4, when the fluid flowing from the outer side in the radial direction toward the intake casing opening 43 passes through the guide flow path VP between the vanes 50, the flow direction with respect to the radial direction of the axis O is changed by the exit angle θ.

The shapes of the vanes 50 thus configured are different between the first vane 51 provided in the first region S1 and the second vane 52 provided in the second region S2 as described above. More specifically, as illustrated in FIG. 2, the exit angle θ of the first vane 51 is set to be larger than the exit angle θ of the second vane 52. That is, the exit angle θ of the first vane 51 is displaced to the volute portion 42 side as compared to the exit angle θ of the second vane 52 when viewed from the volute portion 42. In the first region S1, the first vanes 51 are arranged in the circumferential direction of the intake casing opening 43. In other words, in the present embodiment, the exit angles θ of the individual first vanes 51 are all equal.

Specifically, in the present embodiment, the exit angle θ of the first vane 51 may be in the range of 10° to 20°, and possibly, in the range of 12° to 18°. In one or more embodiments, the exit angle θ is set to 15°.

According to the above configuration, since the exit angle θ of the vane 50 in the first region S1 is displaced to the suction flow path 42A side as compared to the exit angle θ of the second region S2, it is possible to change the flow direction of the fluid in the first region S1 toward the suction flow path 42A (upstream side). As a result, the flow rate distribution of the fluid flowing toward the impeller 2 via the suction flow path 42A can be made substantially equal (balanced) between the first region S1 and the second region S2.

More specifically, the fluid guided by the inlet guide vane V (the first vane 51 and the second vane 52) has a direction component substantially along the rotating direction R of the impeller 2 in the second region S2, and flows into the intake casing opening 43. Meanwhile, the fluid in the first region S1 has a direction component opposite to the rotating direction R of the impeller 2, and flows into the intake casing opening 43.

At this time, in the centrifugal compressor 100 according to the present embodiment, as described above, the flow direction of the fluid in the first region S1 can be changed toward the suction flow path 42A (upstream side) side. That is, the flow direction of the fluid in the first region S1 can be brought close to the rotating direction R of the impeller 2. Thus, it is possible to adjust the head in the impeller passage 71 of the impeller 2 in a downward direction. Therefore, the flow rate distribution of the fluid in the circumferential direction of the intake casing 4 can be set to a substantially uniform distribution as illustrated by the solid line graph in FIG. 4.

Therefore, the flow rate distribution can be balanced in the circumferential direction of the intake casing opening 43 (the impeller 2), and the head of the impeller 2 in the second region S2 and the head in the first region S1 can be set to be equal to each other. Therefore, it is possible to effectively reduce the likelihood of local stalling occurring in the circumferential direction in a part of the impeller 2.

Here, the performance (compression efficiency) of the centrifugal compressor 100 is generally determined by the limit of occurrence of stalling. Therefore, by reducing the limit of occurrence of stalling as described above, it is possible to further improve the performance of the centrifugal compressor 100.

Furthermore, in the present embodiment, the exit angle θ of the first vane 51 is set to 10° to 20° with respect to the radial direction of the impeller 2. Possibly, the exit angle θ is 15°.

According to such a configuration, it is possible to sufficiently change the flow direction of the fluid in the first region S1, and it is also possible to avoid the possibility of excessively limiting the flow rate of the fluid taken in toward the intake casing opening 43. That is, when the exit angle θ is larger than the aforementioned value, there is a possibility that the flow rate of the fluid taken into the intake casing opening 43 may be smaller than an expected amount. However, by adopting the above configuration, such a likelihood can be reduced.

The first embodiment of the present invention has been described with reference to the drawings. However, the dimensions, materials, shapes, relative positions thereof, and the like of the components described in this embodiment are not particularly limited as long as there is no specific description, and various modifications can be added.

Figure 5:
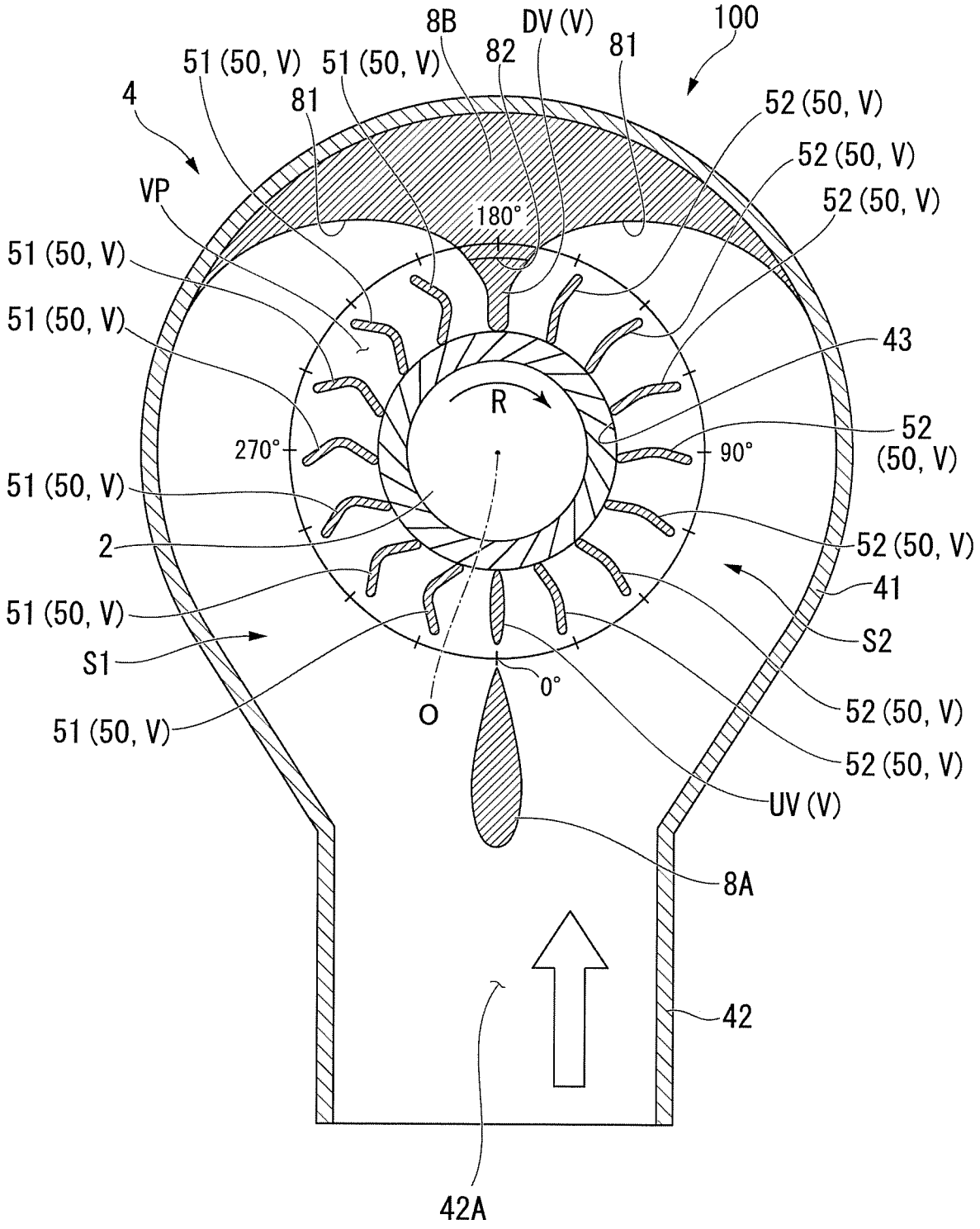
FIG. 5 is a diagram illustrating a modified example of the first embodiment of the present invention.

For example, in the above-described embodiment, an example in which a region on the front side of the impeller 2 in the rotating direction R is set as the first region S1 on which the first vane 51 is provided has been described. However, as illustrated in FIG. 5, a region of the impeller 2 on the rear side in the rotating direction R may be set as the first region S1.

According to such a configuration, in the first region S1 located on the rear side in the rotating direction, the head of the fluid taken into the intake casing opening 43 via the first vane 51 can be set to be smaller than the head in the second region S2. Therefore, it is possible to equally balance the flow rate distribution of the fluid in the circumferential direction of the intake casing opening 43 in the first region S1 and the second region S2. Similarly to the aforementioned embodiment, it is then possible to improve various performance values including the compression efficiency of the centrifugal compressor 100.

In the aforementioned first embodiment, the angle formed by the trailing edge portion 50C with respect to the radial direction (exit angle θ) has been described in detail, but the angle formed by the leading edge portion 50B with respect to the radial direction may be appropriately determined depending on design or specifications. That is, as long as the bending direction of the leading edge portion 50B with respect to the trailing edge portion 50C faces the upstream side, any aspect may be adopted.

Second Embodiment

Figure 6:
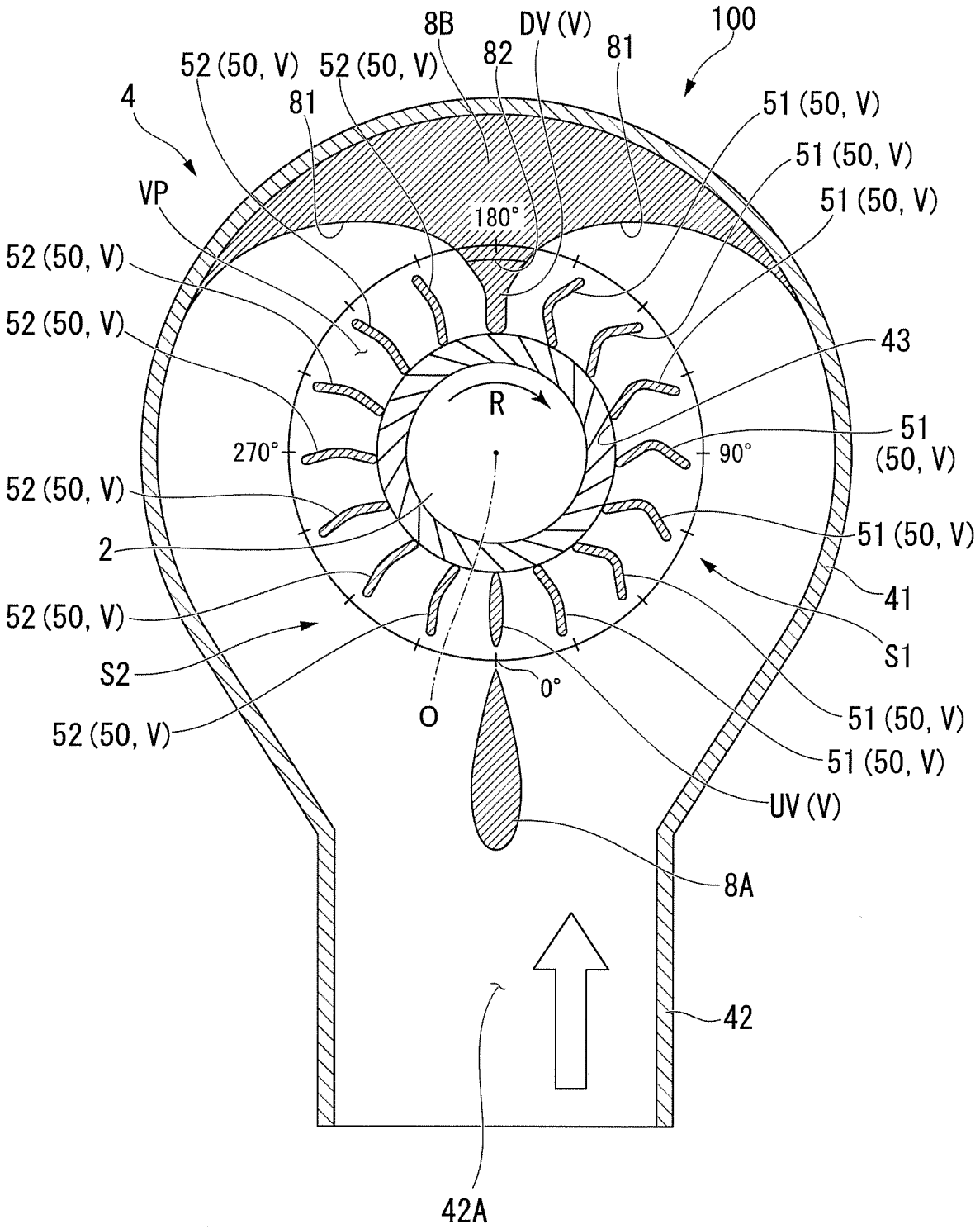
FIG. 6 is a diagram illustrating an arrangement of inlet guide vanes according to a second embodiment of the present invention.

Subsequently, a second embodiment of the present invention will be described with reference to FIG. 6. As illustrated in FIG. 6, in the centrifugal compressor 100 according to the present embodiment, the arrangement and shape of the inlet guide vane V are different from those of the aforementioned first embodiment in the following points. That is, in the present embodiment, among the first vanes 51 provided in the first region S1, only in the first vane 51 in the region from the 45° position to the 180° position in the circumferential direction, the exit angle θ is displaced to be larger than the exit angle θ of the second vane 52. More specifically, only in this specific first vane 51, the exit angle θ is displaced toward the suction flow path 42A (volute portion 42) side as compared to the exit angle θ of the second vane 52.

Figure 4:
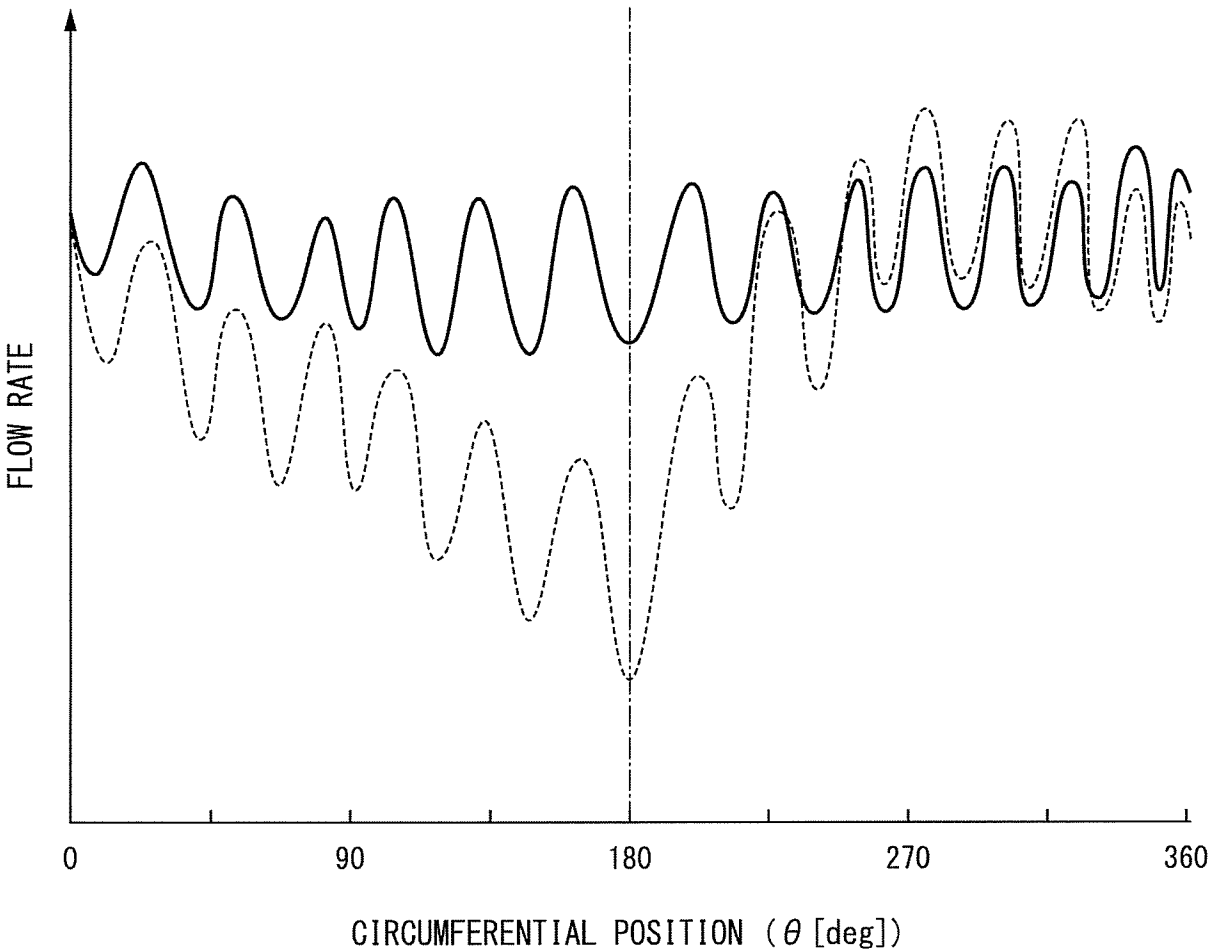
FIG. 4 is a graph illustrating an example of a flow rate distribution of a fluid in a circumferential direction in an intake casing opening according to the first embodiment of the present invention.

Here, in the centrifugal compressor 100 having the intake casing 4 as in the present embodiment, as illustrated by a dotted line graph in FIG. 4, it is known that deviation of the flow rate distribution particularly tends to occur in the region from 45° to 180° with the volute portion 42 as a reference.

In the present embodiment, only the first vane 51 in the region from the 45° position to the 180° position in the circumferential direction has the exit angle θ displaced to be greater than the exit angle θ of the second vane 52. Therefore, in the region in which uneven distribution of the flow rate is significant as described above, it is possible to prioritize balancing the flow rate. This makes it possible to further improve the compression efficiency of the centrifugal compressor 100 as compared with the first embodiment.

In addition, in the present embodiment, the exit angle θ of the first vane 51 in the region from the 0° position to the 45° position is substantially equal to that of the second vane 52. In the vicinity of the 0° position, since the fluid flows substantially linearly from the volute portion 42 toward the downstream side, it is difficult for deviation to occur in the flow rate distribution, irrespective of the first region S1 and the second region S2. Therefore, according to the configuration of the present embodiment, it is possible to reduce the likelihood of the flow rate distribution of the fluid in this region being disturbed.

Third Embodiment

Figure 7:
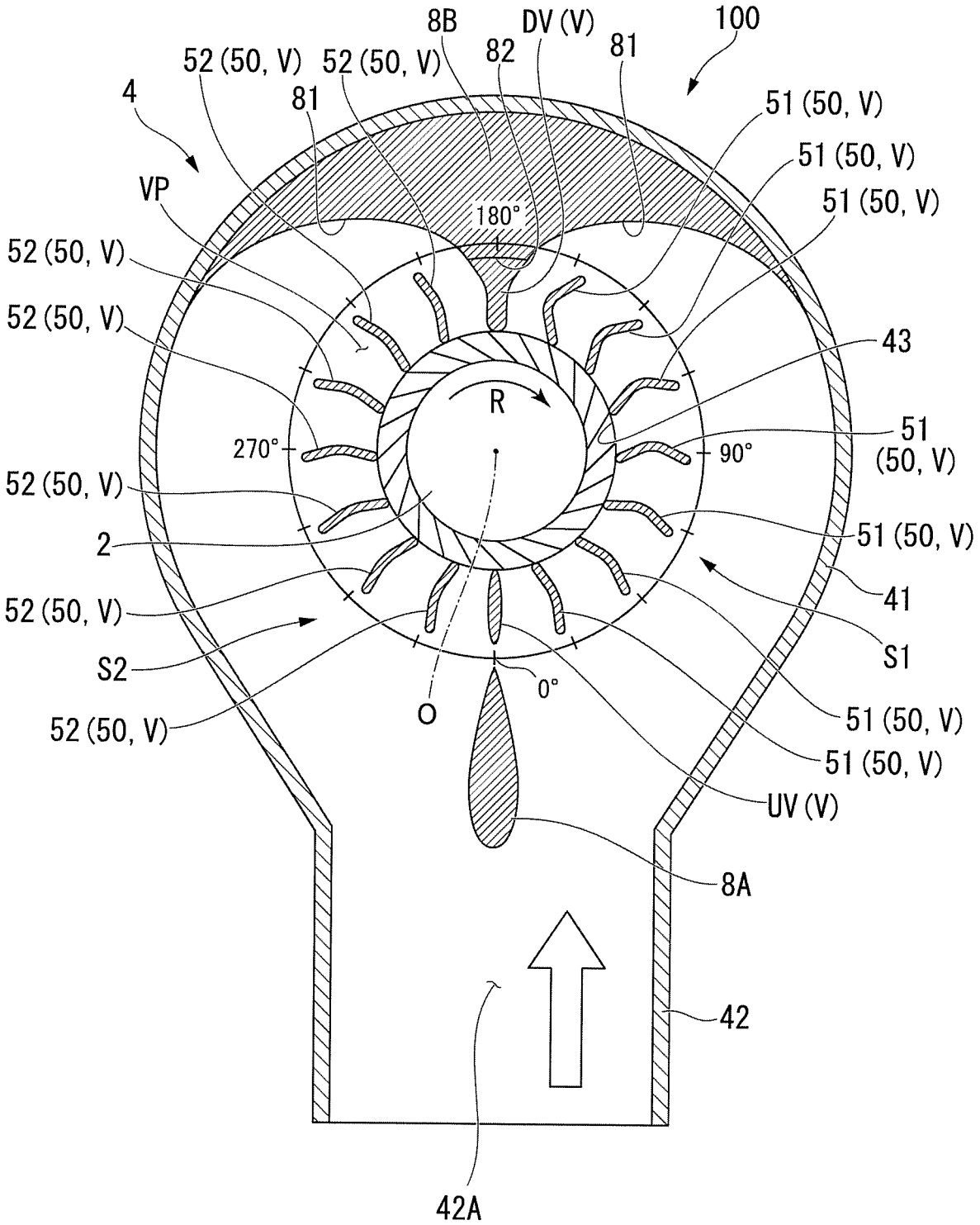
FIG. 7 is a diagram illustrating an arrangement of an inlet guide vane according to a third embodiment of the present invention.

Next, a third embodiment of the present invention will be described with reference to FIG. 7. As illustrated in FIG. 7, the centrifugal compressor 100 according to the third embodiment is configured so that the exit angle θ of the first vane 51 in the first region S1 gradually increases from the 0° position to the 180° position. That is, the exit angle θ of the first vane 51 is set to be relatively small at a position (upstream side) close to the volute portion 42, and meanwhile, the exit angle θ of the first vane 51 is set to be relatively large in the vicinity of the 180° position on the downstream side.

According to such a configuration, it is possible to better balance the flow rate distribution of the fluid in the first region S1. In the first region S1, the angle formed by the flow direction of the fluid with respect to the rotating direction R of the impeller 2 gradually changes from the 0° position to the 180° position. As in the present embodiment, as long as there is a configuration in which the exit angle θ of the first vane 51 increases from the 0° position to the 180° position, the angle formed by the fluid flow direction can be set to more appropriately correspond to the rotating direction R of the impeller 2. Therefore, the compression efficiency of the centrifugal compressor 100 can be further improved.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Rotary shaft
2 Impeller
2A Hub
2B Blade
3 Casing main body
4 Intake casing
5A Journal bearing
5B Thrust bearing
6 Discharge port

7 Main flow path
8A Upstream straightening portion
8B Downstream straightening portion
41 Annular portion
42 Volute portion
42A Suction flow path
43 Intake casing opening
50 Vane
50A Curved portion
50B Leading edge portion
50C Trailing edge section
51 First vane
52 Second vane
71 Impeller passage
81 Arc portion
82 Ridge portion
100 Centrifugal compressor
DV Downstream vane
O Axis
R Rotating direction of impeller
S1 First region
S2 Second region
UV Upstream vane
V Inlet guide vane
VP Guide flow path
θ Exit angle

The invention claimed is:

1. A centrifugal compressor comprising:

an impeller that rotates about an axis;

an inlet guide vane comprising a plurality of vanes disposed on one side of the impeller in an axial direction and provided at intervals in a circumferential direction of the axis, wherein the inlet guide vane is directed inward in a radial direction between adjacent vanes, and forms a guide flow path having an exit angle in the radial direction and guiding a fluid; and a suction flow path that introduces the fluid from a part in the circumferential direction into the inlet guide vane, wherein the plurality of vanes comprise first vanes disposed on a first region on the one side when viewed from the suction flow path in the inlet guide vane and second vanes disposed on a second region on an opposite side of the one side, wherein exit angles of the first vanes are displaced to the suction flow path side as compared to exit angles of the second vanes, wherein the exit angle of each first vane is set to be larger than the exit angle of a corresponding second vane, wherein the exit angles of the individual first vanes are all equal, and wherein the exit angle of the first vane in a region in which an angular coordinate about the axis in the circumferential direction from the suction flow path as viewed from the axial direction in the first region is in the range of 45° to 180° is displaced toward the suction flow path side compared to the exit angle of the second vane of the second region.

2. The centrifugal compressor according to claim 1, wherein the first region is on a front side of the impeller in a rotating direction when viewed from the suction flow path in the inlet guide vane.

3. The centrifugal compressor according to claim 1, wherein the first region is on a rear side of the impeller in a rotating direction when viewed from the suction flow path in the inlet guide vane.

4. The centrifugal compressor according to claim 1, wherein the exit angle of the first vane is in between 10° to 20° with respect to the radial direction of the impeller.

5. The centrifugal compressor according to claim 1, wherein the exit angle becomes larger in the first region, as the first vane provided at a position spaced apart from the suction flow path in the circumferential direction.

* * * * *